United States Patent [19]

Pye

[11] Patent Number: 4,969,072

[45] Date of Patent: Nov. 6, 1990

[54] LAMP REFLECTOR

[75] Inventor: Stephen Pye, Sutton Coldfield, England

[73] Assignee: Carello Lighting Plc, Cannock, England

[21] Appl. No.: 486,347

[22] Filed: Feb. 28, 1990

[30] Foreign Application Priority Data

Mar. 1, 1989 [GB] United Kingdom ..... 8904813

[51] Int. Cl.[5] ..... F21V 7/02

[52] U.S. Cl. ..... 362/310; 362/226; 362/433

[58] Field of Search ..... 362/257, 226, 296, 310, 362/341, 433; 313/318

[56] References Cited

U.S. PATENT DOCUMENTS 4,760,506 7/1988 Mochizuki et al. ..... 362/226

4,811,178 3/1989 Ernst et al. ..... 362/226

4,872,096 10/1989 Montet ..... 362/226

FOREIGN PATENT DOCUMENTS 2802317 7/1979 Fed. Rep. of Germany ..... 362/226

*Primary Examiner*—Stephen F. Husar

*Attorney, Agent, or Firm*—Jenner & Block

[57] ABSTRACT

A lamp reflector has a dished body with a lamp-receiving sleeve having an open end. Spring clips hold a lamp so that lugs on a flange of the latter engage against the base of slots in the sleeve. Each clip has a pair of legs which embrace the wall of the sleeve. The inner leg has a hooked end engaging over an internal rib in the sleeve. Each clip also includes an arm having a region which engages against the flange of the lamp to hold the latter in position.

20 Claims, 1 Drawing Sheet

LAMP REFLECTOR

Figure 1:
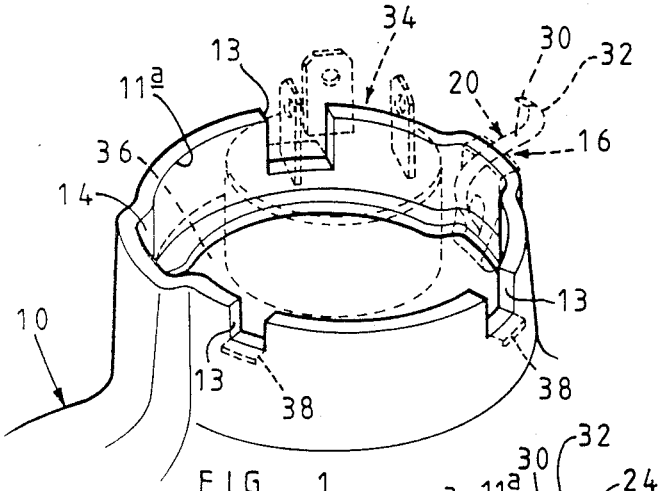

This invention relates to a lamp reflector and to a light assembly including the same. The invention is more particularly, though not exclusively, concerned with a motor vehicle headlamp reflector.

In lamp reflectors for motor vehicle headlight assemblies, it is necessary for the light source to be accurately located relative to the reflector in order to ensure that the correct beam pattern is projected by the assembly in use. It is common practice to use a light source provided by a quartz halogen lamp having a laterally projecting flange with supporting lugs which are designed to engage in slots formed in the rear end of a sleeve projecting rearwardly of the reflector. The reflector has a rear aperture opening into the sleeve for receiving the lamp. In order to secure the lamp in position, a lamp-retaining device is provided. Such retaining device also has to be disengageable from the lamp in order to enable lamp replacement. It is becoming increasingly common for lamp reflectors to be formed by an injection moulding technique out of synthetic plastics material because this enables the production of complex reflector shapes which cannot be accurately produced by a sheet metal stamping operation. Various proposals have been made for lamp-retaining devices for use with lamp reflectors formed of synthetic plastics material. Such proposals generally involve the use of complex tooling to produce undercuts in the lamp reflector whereby to form anchor points for the bulb retaining device, or they involve subjecting the moulded plastics reflector to further operations in order to provide suitable anchorages for the lamp retaining device. The former proposal involves the use of tool inserts which are prone to damage and wear and which also can disrupt the flow of synthetic plastics material being injected, thus causing distortion of the component. Subjecting the injection moulded lamp reflector to further operations in order to produce a suitable anchorage for the bulb retaining device increases the production cost. Other types of lamp retaining device have been previously proposed which involve using a device which is freely pivoted on the lamp reflector and which is moved into a lamp retaining position after insertion of the lamp. Still further devices have been proposed which are only engaged with the lamp reflector after the lamp has been inserted. In both of these cases, difficulties arise when it is desired to provide a completely automated assembly plant for insertion of the lamp into the reflector and retaining it therein.

Typical examples of the above mentioned previously proposed bulb retaining devices are disclosed in U.S. Pat. Nos. 4507712, 2233486, 3486019, 4219870, 4390931 and 4500946, and British Patent Nos. 1407024, 1196393, 1231463 and 2029953. Additionally, a number of lamp retaining devices are disclosed in EP-A-0147934, in which the lamp is retained in position by means of a spring having a U-shaped anchor portion which is frictionally engaged in a recess formed in the lamp reflector adjacent the bulb-retaining sleeve. The spring has a pair of spring arms which are inherently biassed into a position in which they urge abutment surfaces on the lamp into engagement with abutment surfaces on the sleeve. The spring arms are also movable in a direction transverse to the first-mentioned direction to enable the lamp to be inserted into the reflector. Whilst such an arrangement is generally satisfactory, the tooling for the lamp reflector has a relatively fine tongue used to produce the recess, and such tongue tends to be prone to damage and wear.

It is an object of the present invention to provide a lamp reflector which can enable the above mentioned disadvantages to be obviated or mitigated.

According to one aspect of the present invention, there is provided a lamp reflector comprising a dished body having an internal reflective surface and a rear aperture, said body including a lamp-receiving sleeve surrounding the rear aperture and extending rearwardly of the latter to terminate in an open rear end, the sleeve having an abutment means adapted to engage with corresponding abutment means on a mounting flange of a lamp; and at least one lamp-retaining device adapted to retain the lamp in the sleeve in use with said abutment means in mutual engagement; wherein said lamp-retaining device comprises at least one spring clip having at least a pair of legs which embrace part of the wall of the sleeve at the open rear end thereof, at least one of said legs engaging over a formation on the lamp reflector body to retain the clip in position on the sleeve, said at least one clip further including an arm which is biassed inwardly relative to the axis of the sleeve but which can be deflected outwardly to enable passage of the mounting flange of the lamp during assembly of the lamp into the lamp reflector, and said arm, in its inwardly biassed position, projecting into the interior of the sleeve so as to engage the lamp in use and urge said abutment means into mutual engagement.

Normally, the lamp reflector will be provided with two such lamp-retaining devices which are spaced apart substantially diametrically of the sleeve.

The present invention is particularly applicable to lamp reflectors wherein the wall of the sleeve has slots therein which extend forwardly from the open rear end of the sleeve to terminate at an intermediate region of the sleeve in a common plane. The purpose of such slots is to accept a standard type of lamp whose mounting flange has outwardly projecting lugs (forming the abutment means of the lamp) which engage in the respective slots whose bases form the abutment means of the sleeve. With such a type of lamp reflector and lamp, the lamp-retaining device used in the present invention abuts against the mounting flange of the lamp so as to urge the lugs into engagement with the bases of the slots in the sleeve.

In a particularly preferred embodiment, the formation with which said at least one leg of the clip is engaged is an annular rib formed internally of the sleeve. In the case where the dished reflector and sleeve are integrally formed out of a synthetic plastics material by means of an injection moulding operation in which the moulding material is injected through a moulding gate, it is particularly convenient if the rib forms part of the injection moulding gate. In this way, the synthetic plastics material used to form the reflector body can be injected in a direction axially of the sleeve so that the material passes outwardly in all directions through the gate in an uninterrupted flow over the surfaces which define the reflector shape. After moulding, the injection sprue and most of the gate can then be removed so as to leave merely the rib within the sleeve.

The clip will usually be formed of spring steel, although it is within the scope of the present invention to use a suitably resilient plastics clip. Because the lamp reflector body has to be rigid, it is generally not practicable for the clip to be integrally formed with the reflector body.

In order to limit unwanted lateral movement of the lamp relative to the reflector body, it is usual for the mounting flange of the lamp to be a close fit within the sleeve. Accordingly, it is preferred in the present invention for the or each leg of the clip which is disposed within the sleeve to be received in a localised recess in the internal wall of the sleeve.

In a preferred embodiment, in order to facilitate automated assembly of the lamp into the sleeve, it is preferred for the arm of the or each clip to extend inwardly and rearwardly relative to the sleeve from the junction with the remainder of the clip, and then to continue rearwardly and outwardly relative to the sleeve. With such a construction, the free end of the arm preferably projects rearwardly out of the sleeve. However, in a convenient embodiment, the portion of the arm which projects outwardly of the sleeve is preferably arranged to lie substantially in a plane in which the rear end of the sleeve lies. In this way, the clip can be assembled onto the sleeve after the injection moulding operation is completed and the resultant lamp assemblies can then be stacked one inside the other for space saving storage/-transport purposes, it being appreciated that the dished bodies of the lamp reflectors will nest conveniently one inside the other.

According to another aspect of the present invention, there is provided a motor vehicle light unit comprising a lamp reflector according to said one aspect of the present invention having a lamp mounted in said sleeve and retained therein by said retaining device.

Figure 2:
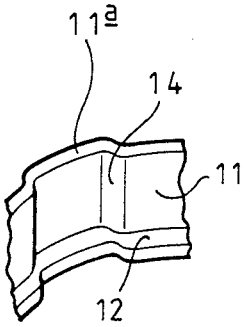
Figure 3:
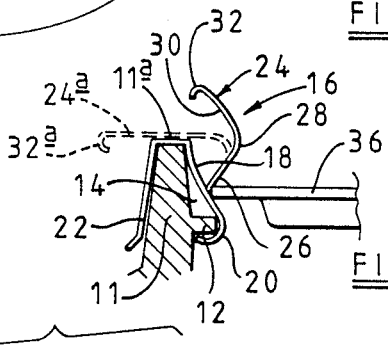
Figure 4:
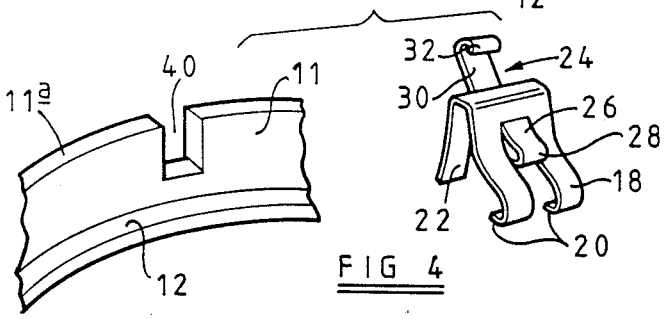
Figure 5:
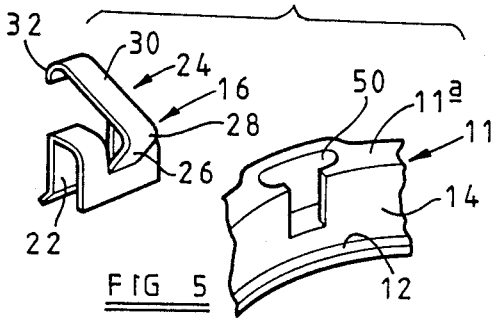

Embodiments of the present invention will now be described, by way of example, with reference to the accompanying drawings, in which:

FIG. 1 is a schematic perspective view of the rear part of a lamp reflector according to the present invention, FIG. 2 is a detail of part of the lamp reflector of FIG. 1, FIG. 3 is an axial section through part of the lamp reflector illustrated in FIG. 1, FIG. 4 is a schematic perspective view showing a first modification of the lamp reflector of FIG. 1, and FIG. 5 is a schematic perspective view showing a second modification to the lamp reflector of FIG. 1.

Referring now to FIGS. 1 to 3, the lamp reflector illustrated therein is for a motor vehicle headlight unit and comprises a dished body 10 (only partly shown). The body 10 is open at its front (not shown) and has a central rear aperture. A lamp-receiving sleeve 11 extends rearwardly of the remainder of the body to terminate in an open rear end 11*a*. The reflector body 10 is injection moulded out of a low profile, thermosetting polyester dough moulding composition. An internal surface of the dished body is rendered reflective by means of a vacuum deposited aluminium film in a manner per se known in the art. The injection moulding operation is effected axially of the body 10 so that the material being injected passes into the injection moulding die outwardly in all directions through a diaphragm type moulding gate where the diaphragm is disposed within the sleeve 11 adjacent the front end thereof which surrounds the rear aperture. After injection moulding, the sprue which extends axially within the sleeve 11 and which is not shown in the drawings is removed along with an inner portion of the diaphragm type gate. An outer portion of the gate is left within the sleeve 11 and defines an inner annular rib 12 (see FIGS. 2 and 3). The die parts used to form the sleeve 11 are shaped so as to form three angularly spaced slots 13 in the sleeve 11, the slots extending from the open rear end 11*a* of the sleeve 11 forwardly of the body 10 to terminate in a common plane which lies perpendicular to the axis of the sleeve 11 and intermediate the ends of the latter. The die parts used to form the sleeve 11 are also shaped so as to define a pair of diametrically opposed recesses 14 in the internal wall of the sleeve 11.

The lamp reflector comprises a pair of lamp-retaining devices each in the form of a clip 16 (see FIGS. 1 and 3). Each clip 16 is formed out of a strip of spring steel by a cutting and bending operation. Each clip 16 comprises an inner leg 18 which extends for the full width of the clip 16 and which terminates in a hooked end 20. The clip also comprises a pair of outer legs 22. Part of the material between the legs 22 is cut and bent so as to define an arm 24.

Each clip 16 is engaged with the sleeve 11 by passing it over the wall at the open rear end 11*a* of the sleeve 11 so that the legs 22 lie on the outside of the sleeve 11, whilst the leg 18 lies on the inside of the sleeve within the respective recess 14. The length of the leg 18 is chosen so that forcing the clip 16 over the sleeve 11 and against the rear end 11*a* causes the hooked end 20 to be deflected outwardly over the rib 12 so that it is then free to snap back behind the rib 12 and thereby hold the clip 16 securely in position against unwanted detachment from the sleeve 11. In this position, the arm 24 from its junction with the leg 18 extends first inwardly and rearwardly with respect to the sleeve 11 at region 26 before curving smoothly at region 28 so as to extend rearwardly and outwardly with respect to the sleeve 11 over region 30. The arm 24 finally terminates in a sharply turned-over end 32.

The above-described lamp reflector is designed for use with a conventional H4 quartz halogen lamp 34 having an annular mounting flange 36 with three angularly spaced mounting lugs 38. The mounting lugs 38 are angularly spaced apart around the mounting flange 36 and lie in a common plane so as to define abutment means on the lamp 34. The mounting lugs 38 are of a size to engage in the respective slots 13 formed in the sleeve 11 and the arrangement of lugs 38 and slot 13 is specifically designed so as to ensure that a filament (not shown) defining a light source of the lamp 34 is accurately disposed at the required position relative to the reflective surface in the body 10. The bases of the slots 13 are engaged by the lugs 38 in a fully assembled position of the lamp 34 and define abutment means on the sleeve 11.

In order to assemble the lamp 34 into the collar 11, the lamp 34 is inserted into the open end of the sleeve 11 until the mounting flange 36 engages against the portions 30 of the clips 16. The portions 30 are angled so as to provide a lead-in to assist in insertion of the lamp 34. Further movement of the lamp 34 into the sleeve 11 causes the arms 24 to be deflected outwardly until the mounting flange 36 has passed the portions 28 of the clips 16. Upon further movement of the lamp 34 into the sleeve 11, the arms 24 are free to flex inwardly to adopt their naturally inwardly biassed position so that the mounting flange 36 is retained against unwanted removal by engagement of the portions 26 of the clips 16 against the rear of the mounting flange 36. It will be appreciated that, during assembly of the lamp 34 into the sleeve 11, it will be angularly orientated so as to bring the lugs 38 into alignment with the appropriate slots 13 in the sleeve 11 so that correct orientation of the filament of the lamp 34 relative to the reflector is ensured.

When it is desired to remove the lamp 34 from the sleeve 11 (for example in the event that the lamp filament fails), it is merely necessary to deflect the arms 24 outwardly against their inherent inward biassing until the portions 28 lie outwardly of the flange 36. The lamp 34 is then released and can be easily removed from the sleeve 11.

In a modification illustrated in dotted line in FIG. 3, the arm 24, instead of projecting for a distance rearwardly of the sleeve 11, is turned outwardly so that portion 24*a* extends substantially radially relative to the axis of the sleeve 11 and lies close to the plane in which the open rear end 11*a* of the sleeve 11 lies. Such an arrangement facilitates nesting of one lamp reflector inside another and so enables the clips 16 modified as illustrated in dotted line in FIG. 3, to be attached to the lamp reflector 11 immediately upon injection moulding thereof. It will be appreciated that, after injection moulding, lamp reflectors are generally nested together for ease of storage and transport to the next operation to be performed thereon.

The above-described clip is economical to manufacture and is efficient in use. The manner in which it is secured to the sleeve 11 enables the sleeve 11 to be constructed in such a way that injection moulding of the body 10 can be effected with a uniform flow of moulding material, thus reducing the risk of distortion of the body through disruption of the flow of material being injection moulded.

Referring now to FIG. 4 of the drawings, the modification illustrated therein simplifies somewhat the die used to form the sleeve 11. In this embodiment, the recess 14 is replaced by a relatively simple slot 40 and the clip 16 is re-designed so that it has two inner legs 18 and two outer legs 22 (only one shown). The arm 24 in this embodiment extends forwardly and inwardly relative to the sleeve 11 over region 26 before turning smoothly at 28 over a small radius outwardly and rearwardly to pass between the legs 18, through the slot 40, and between the legs 22 so as to project externally of the sleeve 11. The region 30 of the arm 24 in this embodiment extends outwardly and rearwardly of the sleeve 11 to terminate in turned-over end 32. It will be appreciated that, in this embodiment, portion 26 of arm 24 provides a relatively short lead-in for the flange 36 and that release of the lamp 34 from the sleeve 11 can be effected by pressing the turned-over ends 32 of the arms 24 inwardly relative to the sleeve 11. Such inward movement of the ends 32 causes the portions 26 to be deflected outwardly to allow passage of the flange 36 of the lamp 34. In this embodiment, each leg 18 has hooked end portion 20 which snap fits over rib 12.

In the embodiment of FIG. 5, sleeve 11 is formed with a pair of recesses 14 therein and also with a pair of slots 50 which extend from the open rear end 11*a* of the sleeve 11 into the wall. Each slot 50 communicates with the respective recess 14 and so can be provided by a suitably shaped formation on the moulding tool used to define the inner wall of the sleeve 11 and the recesses 14. Each slot 50 receives outer legs 22 of respective clip 16. In this embodiment, the arm 24 is similar to that described above with reference to FIGS. 1 to 3. However, leg 18 is not provided with hooked portion 20 and merely rests against the rib 12. The legs 22 have outwardly turned lower ends so that they can be force fitted into the slot 50 and thereby retained therein without the need to provide a mechanical locking action between leg 18 and rib 12.

What is claimed:

1. A lamp reflector comprising a dished body having an internal reflective surface and a rear aperture, said body including a lamp-receiving sleeve surrounding the rear aperture and extending rearwardly of the latter to terminate in an open rear end, the sleeve having an abutment means adapted to engage with corresponding abutment means on mounting flange of a lamp; and at least one lamp-retaining device adapted to retain the lamp in the sleeve in use with said abutment means in mutual engagement; characterized in that said lamp-retaining device comprises at least one spring clip having at least a pair of legs which embrace part of the wall of the sleeve at the open rear end thereof, in that at least one of the said legs engages over a formation on the body to retain the clip in position on the sleeve, in that said at least one clip further includes an arm which is biassed inwardly relative to the axis of the sleeve but which can be deflected outwardly to enable passage of the mounting flange of the lamp during assembly of the lamp into the lamp reflector, and in that said arm, in its inwardly biassed position, projects into the interior of the sleeve so as to engage the lamp in use and urge said abutment means into mutual engagement.

2. A lamp reflector as claimed in claim 1, wherein a plurality of lamp-retaining devices are provided in spaced apart relationship about the axis of the sleeve.

3. A lamp reflector as claimed in claim 1, wherein the formation with which said at least one leg of the clip is engaged is an annular rib formed internally of the sleeve.

4. A lamp reflector as claimed in claim 3, wherein the rib forms a part of an injection moulding gate.

5. A lamp reflector as claimed in claim 1, wherein the arm of the or each clip has a first region which extends inwardly and rearwardly relative to the sleeve from a junction with the remainder of the clip, and a second which continues from said first region rearwardly and outwardly relative to the sleeve.

6. A lamp reflector as claimed in claim 5, wherein the free end of the arm projects rearwardly out of the sleeve.

7. A lamp reflector as claimed in claim 5, wherein the second region of the arm lies substantially in a plane in which the rear end of the sleeve lies.

8. A lamp reflector as claimed in claim 1, wherein the sleeve has a slot therein, and the arm of the clip has a first region which extends forwardly and inwardly to the sleeve and a second region which continues from the first region rearwardly and outwardly relative to the sleeve so as to pass through the slot and project externally of the sleeve.

9. A lamp reflector as claimed in claim 1, wherein the or each leg of the clip which is disposed within the sleeve is received in a localised recess in the internal wall of the sleeve.

10. A lamp reflector as claimed in claim 2, wherein the or each leg of the clip which is disposed within the sleeve is received in a localised recess in the internal wall of the sleeve.

11. A lamp reflector as claimed in claim 3, wherein the or each leg of the clip which is disposed within the sleeve is received in a localised recess in the internal wall of the sleeve.

12. A lamp reflector as claimed in claim 4, wherein the or each leg of the clip which is disposed within the sleeve is received in a localised recess in the internal wall of the sleeve.

13. A lamp reflector as claimed in claim 1, wherein the sleeve has a slot extending from the rear end into the wall of the sleeve and communicating with the interior of the latter, and wherein at least one of the legs engages in the slot.

14. A lamp reflector as claimed in claim 2, wherein the sleeve has a slot extending from the rear end into the wall of the sleeve and communicating with the interior of the latter, and wherein at least one of the legs engages in the slot.

15. A lamp reflector as claimed in claim 3, wherein the sleeve has a slot extending from the rear end into the wall of the sleeve and communicating with the interior of the latter, and wherein at least one of the legs engages in the slot.

16. A lamp reflector as claimed in claim 4, wherein the sleeve has a slot extending from the rear end into the wall of the sleeve and communicating with the interior of the latter, and wherein at least one of the legs engages in the slot.

17. A lamp reflector as claimed in claim 9, wherein the sleeve has a slot extending from the rear end into the wall of the sleeve and communicating with the interior of the latter, and wherein at least one of the legs engages in the slot.

18. A lamp reflector as claimed in claim 5, wherein the sleeve has a slot extending from the rear end into the wall of the sleeve and communicating with the interior of the latter, and wherein at least one of the legs engages in the slot.

19. A lamp reflector as claimed in claim 6, wherein the sleeve has a slot extending from the rear end into the wall of the sleeve and communicating with the interior of the latter, and wherein at least one of the legs engages in the slot.

20. A lamp reflector as claimed in claim 7, wherein the sleeve has a slot extending from the rear end into the wall of the sleeve and communicating with the interior of the latter, and wherein at least one of the legs engages in the slot.

* * * * *